US011749100B2

(12) United States Patent
Kumar

(10) Patent No.: US 11,749,100 B2
(45) Date of Patent: Sep. 5, 2023

(54) SYSTEM AND METHODS TO PROVIDE EMERGENCY SUPPORT USING LIGHTING INFRASTRUCTURE

(71) Applicant: SIGNIFY HOLDING B.V., Eindhoven (NL)

(72) Inventor: Rohit Kumar, Hackensack, NJ (US)

(73) Assignee: SIGNIFY HOLDING B.V., Eindhoven (NL)

( * ) Notice: Subject to any disclaimer, the term of this patent is extended or adjusted under 35 U.S.C. 154(b) by 103 days.

(21) Appl. No.: 17/610,869

(22) PCT Filed: May 25, 2020

(86) PCT No.: PCT/EP2020/064365
§ 371 (c)(1),
(2) Date: Nov. 12, 2021

(87) PCT Pub. No.: WO2020/239657
PCT Pub. Date: Dec. 3, 2020

(65) Prior Publication Data

US 2022/0246024 A1 Aug. 4, 2022

Related U.S. Application Data

(60) Provisional application No. 62/854,457, filed on May 30, 2019.

(30) Foreign Application Priority Data

Jul. 17, 2019 (EP) ..... 19186846

(51) Int. Cl.
*G08B 29/18* (2006.01)
*G08B 25/00* (2006.01)

(52) U.S. Cl.
CPC ..... *G08B 29/188* (2013.01); *G08B 25/00* (2013.01)

(58) Field of Classification Search
CPC ..... G08B 29/188
See application file for complete search history.

(56) References Cited

U.S. PATENT DOCUMENTS

| | | | | |
|---|---|---|---|---|
| 6,816,085 | B1 * | 11/2004 | Haynes | G08G 1/14 348/148 |
| 7,123,166 | B1 * | 10/2006 | Haynes | G08G 1/14 348/148 |
| 11,308,775 | B1 * | 4/2022 | Sinha | G06V 20/52 |
| 2013/0293877 | A1 | 11/2013 | Ramer et al. | |
| 2017/0042003 | A1 | 2/2017 | Logvinov | |
| 2017/0068861 | A1 | 3/2017 | Miller et al. | |

(Continued)

FOREIGN PATENT DOCUMENTS

| | | | |
|---|---|---|---|
| KR | 101915412 | B1 | 11/2018 |
| WO | 2013093771 | A1 | 6/2013 |

(Continued)

*Primary Examiner* — Travis R Hunnings

(57) ABSTRACT

A system and methods are provided for an emergency support system installed in light poles. Each emergency support system continuously monitors for motion to identify anomalous motion activity on a local level. In response, a notification is sent to a base station that provides a global analysis by collecting motion data from nearby emergency support systems. An alert is generated if anomalous motion is detected across multiple emergency support systems.

15 Claims, 7 Drawing Sheets

(56) References Cited

U.S. PATENT DOCUMENTS

| | | | | |
|---|---|---|---|---|
| 2017/0069209 | A1 | 3/2017 | Beaurepaire et al. | |
| 2018/0198865 | A1 | 7/2018 | Kurihara et al. | |
| 2019/0045378 | A1 | 2/2019 | Rosales et al. | |
| 2019/0103021 | A1 | 4/2019 | Rosen et al. | |
| 2020/0226892 | A1* | 7/2020 | Coles ..... | G08B 5/38 |

FOREIGN PATENT DOCUMENTS

| | | | |
|---|---|---|---|
| WO | 2014126470 | A1 | 8/2014 |
| WO | 2017016862 | A1 | 2/2017 |

* cited by examiner

SYSTEM AND METHODS TO PROVIDE EMERGENCY SUPPORT USING LIGHTING INFRASTRUCTURE

CROSS-REFERENCE TO PRIOR APPLICATIONS

This application is the U.S. National Phase application under 35 U.S.C. § 371 of International Application No. PCT/EP2020/064365, filed on May 25, 2020, which claims the benefit of European Patent Application No. 19186846.2, filed on Jul. 17, 2019, and U.S. Provisional Application No. 62/854,457, filed on May 30, 2019. These applications are hereby incorporated by reference herein.

FIELD OF THE INVENTION

The invention relates to a system and methods leveraging a pre-existing, roadside lighting infrastructure to further provide an emergency support system to identify anomalous movement and effectively dispatch authorities.

BACKGROUND

People who are stranded on the road may need emergency response, typically provided by the government. Call boxes exist at regular intervals along the sides of many highways and rapid transit lines around the world, where drivers or passengers can use them to contact a control center in case of an accident or other emergency. Call boxes can be expensive to maintain.

Call boxes may simply have four buttons to push: blue for accident or other emergency (send police/fire/medical), green for major service (mechanical breakdown, send a tow truck), black for minor service (out-of-gas or flat tire), and yellow for cancel. Roads in other places may have voice call boxes, though these are more expensive, and must either be wired long distances, or rely on spotty rural mobile phone service.

Since the popularization of cell phones, the use for call boxes has diminished, thereby reducing the justification of its cost. However, cell phones suffer reliability concerns, particularly battery life and cellular signal. If a cell phone is unable to make a call, then a call box may be the only alternative for a stranded traveler to obtain help.

Light poles are placed at regular intervals to provide sufficient light for improving visibility during nighttime driving. These light poles form a pre-existing infrastructure that is powered by a power grid. In some cases, light poles have sensors to provide limited capabilities of detecting when to turn the light on and off. For example, a light pole may have a light sensor to detect if it is dark enough to turn the light pole light on for energy conservation purposes. Light poles, thus, lack the intelligence to provide additional functionality for emergency support.

There exists lighting systems that include a combination of lights and sensors that are networked together. Such systems include a processor and memory along with program logic to carry out various operations based on data collected by the sensors. For example, the amount of light output or the manner of light output may be controlled based on reading the data from sensors. To the extent such lighting systems are adaptable for emergency support, there are several technical drawbacks. For example, such lighting and sensor systems have limitations in properly identifying emergencies that warrant appropriate action. Such systems may require the use of expensive sensors. The use of expensive sensors makes wide spread adoption more difficult. Rural areas occupy vast areas of space, thereby compounding the cost of expensive sensors.

In addition, such lighting and sensor systems may lead to a high rate of false-positive detection of emergencies. For example, such systems may falsely classify an event as emergency based on a sensor reading at a single location. If the false-positive rate becomes high, emergency dispatch services may become strained when attempting to address each sensor detection.

KR101915412B1 purports to relate to a street lighting system for indicating the stop status of a vehicle, which allegedly removes the risk of a collision accident by displaying a notification that indicates a vehicle is stationary. Streetlights installed at predetermined intervals can allegedly sense a stopped vehicle and notify a central controller of the stop. The controller can than allegedly notify other vehicles of the stopped vehicle.

WO2014126470 purports to relate to a lighting control system having a number of lighting units within the system where each lighting unit represents a node that is grouped together on the basis of a geographic location of the lighting unit.

WO2017016862 relates to a system for detecting localized ground position changes using a plurality of lighting units that are fixed to the ground. Each lighting unit comprises a positioning system and a transmitter for transmitting positioning information to a remote central processing unit. The positioning information from the plurality of fixed lighting units is processed to identify local ground position changes. The infrastructure of a networked lighting system as disclosed enables ground information to be determined, for example, by detecting ground movement in response to natural events or man-made activities (such as tunneling, building, extraction of natural resources etc.).

The present disclosure overcomes the problems in the prior art by providing an effective solution for emergency support, particularly in rural/remote areas. Moreover, some advantages include the ability to service large areas in a cost-effective manner and the ability to reduce the rate of false-positives.

SUMMARY OF THE INVENTION

One aspect of the present invention is related to an improved method for implementing emergency support systems in light poles, where the light poles are part of a pre-existing infrastructure along the roadside. The emergency support system may include a sensor, a processor, a memory, and a communication module. The sensor continuously monitors for motion and stores such data in a buffer as sample data. The processor evaluates the sample data to identify the degree of motion and compare it to a threshold amount to determine the occurrence of an anomalous motion event. Thus, each emergency support system locally processes sensor-related sample data using an edge processor.

Another aspect of the present invention relates to a method for transmitting to a base station, data indicating the occurrence of the anomalous motion event. This may be, for example, a flag. The base station is configured to communicate with a plurality of other emergency support systems installed in respective light poles such that each emergency support system records its own sample data. Upon receiving data indicating the occurrence of the anomalous motion event at one emergency support system, the base station may identify a subset of another nearby emergency support system and transmit an instruction to the subset to upload the respective sample data associated with the subset. Thus, the base station performs a global analysis based on a local analysis obtained from an emergency support system.

One embodiment of the present invention relates to a base station that receives the sample data from multiple emergency support systems that are clustered together to perform a global analysis for detecting an anomalous motion event. For example, if an anomalous motion event occurs at multiple emergency support systems at different points in time, the data suggests that a stranded person is walking along the roadside past different light poles. In response, the base station may generate an alert that is transmitted to the appropriate authorities for emergency dispatch.

Another embodiment of the present invention is directed to using a low cost sensor such as, for example, a passive infrared sensor. A low cost sensor may generate a binary indication of whether motion was detected at each sample point. In this case, a degree of motion activity may be determined by calculating the number of consecutive samples that indicate a presence of motion. Alternatively, the degree of motion may be determined by applying a time series calculation or machine-learning algorithm to identify the duration of motion activity expressed in the sample data. One advantage is to avoid using more complex sensors for sensing motion in order to make deployment of emergency support systems a more cost-effective solution.

Another embodiment of the present invention is directed to including in the emergency support system a Global Position System (GPS) module. According to this embodiment the base station obtains time and location data from the GPS module. In another embodiment, each emergency support system has a unique identifier that maps to a particular location. The location may be determined upon commissioning the emergency support system. The location for each uniquely identified emergency support system may be stored in a location database.

Yet another embodiment of the present invention is directed to an emergency support system that periodically transmits sample data at a predetermined interval. In this embodiment, the base station may poll one or more emergency support systems at regular intervals. Alternatively, each emergency support system pushes its sample data at regular intervals to the base station.

BRIEF DESCRIPTION OF THE DRAWINGS

Further details, aspects, and embodiments of the invention will be described, by way of example only, with reference to the drawings. Elements in the figures are illustrated for simplicity and clarity and have not necessarily been drawn to scale. In the Figures, elements which correspond to elements already described may have the same reference numerals. In the drawings, FIG. 1 schematically shows an example of an embodiment of emergency support systems and a base station implemented in the field, FIG. 2 schematically shows an embodiment of an emergency support system, FIG. 3 schematically shows a detail of an example of an embodiment of sample data generated at an emergency support system of FIG. 1, FIG. 4 schematically shows a detail of an example of an embodiment of sample data generated at an emergency support system of FIG. 1, FIG. 5 schematically shows a detail of an example of an embodiment of sample data generated by multiple emergency support systems and received at a base station of FIG. 1.

DETAILED DESCRIPTION OF PREFERRED EMBODIMENTS

Figure 1:
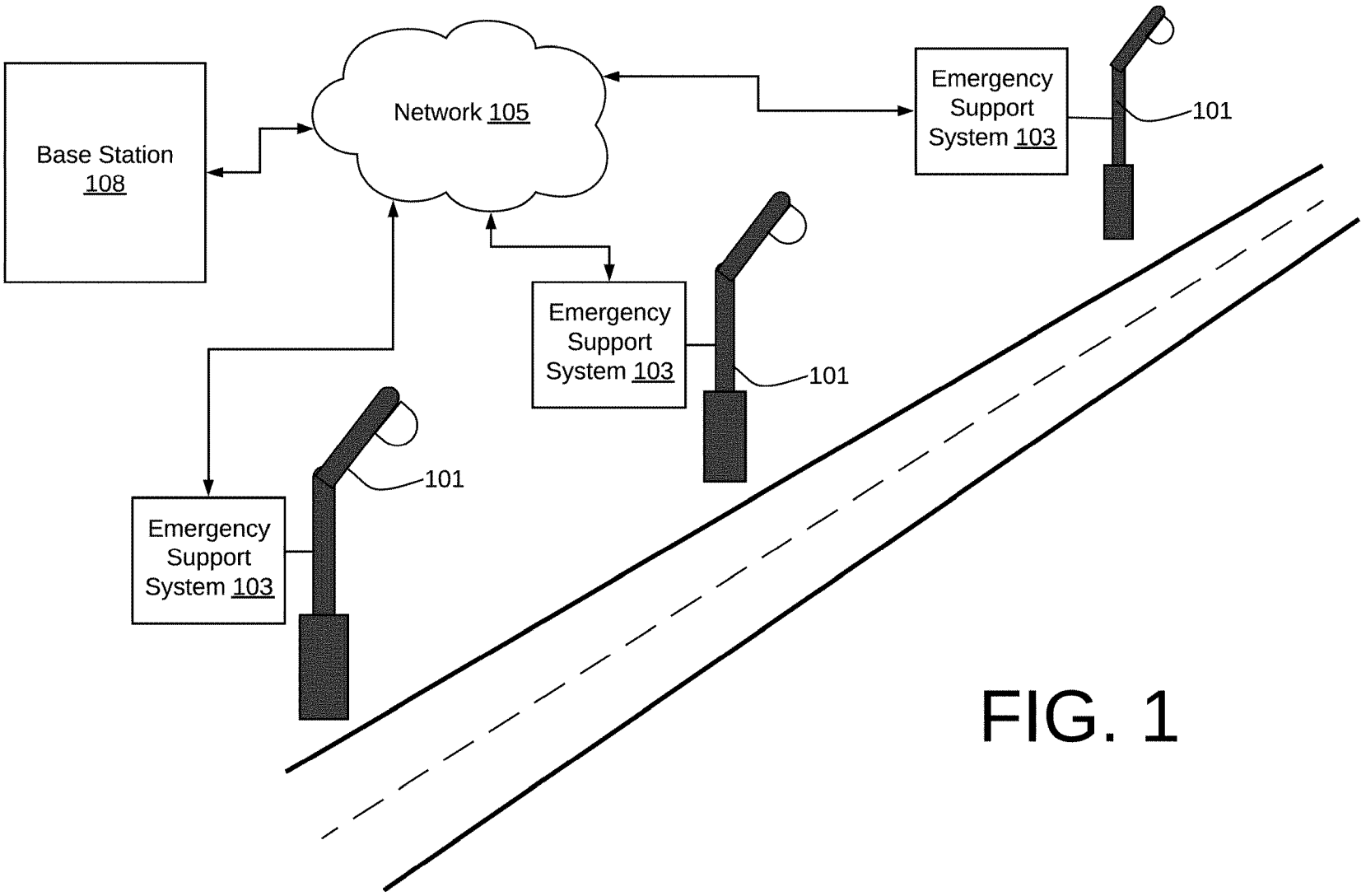

The embodiments shown in the drawings and described in detail herein should be considered exemplary of the principles of the invention and not intended to limit the invention to the specific embodiments shown and described herein.

In the following, for the sake of understanding, elements of embodiments are described in operation. However, it will be apparent that the respective elements are arranged to perform the functions being described as performed by them.

Further, the invention is not limited to the embodiments, and the invention lies in each and every novel feature or combination of features described herein or recited in mutually different dependent claims.

FIG. 1 schematically shows an example of an embodiment of emergency support systems and a base station implemented in the field according to an embodiment of the present invention. FIG. 1 depicts a field suitable for implementing embodiments of the present disclosure. The field may include a roadside area where individuals who are stranded may need emergency services. The field includes a plurality of light poles 101 spread across an area at particular intervals. A light pole 101 is a part of a pre-existing infrastructure that provides light to vehicles driving in the field. Each light pole 101 is powered by a grid that supplies electricity to power the lights.

An emergency support system 103 is installed in each light pole 101. The emergency support system 103 may be implemented as a singular unit, comprising electronic components, that is adapted for installation in the light pole 101. In other embodiments, the emergency support system 103 is a collection of separate components that are communicatively coupled to one another. In either case, the emergency support system 103 provides motion detection and local processing of motion data using an edge processor.

Each emergency support system 103 is configured to communicate via a network 105. The network 105 may be, for example, the Internet, intranets, extranets, wide area networks (WANs), local area networks (LANs), wired networks, wireless networks, or other suitable networks, etc., or any combination of two or more such networks.

FIG. 1 further depicts a base station 108. The base station 108 may comprise, for example, a server computer or any other system providing computing capability. Alternatively, the base station 108 may employ a plurality of computing devices that may be arranged, for example, in one or more server banks or computer banks or other arrangements. Such computing devices may be located in a single installation or may be distributed among many different geographical locations. For example, the base station 108 may include a plurality of computing devices that together may comprise a hosted computing resource, a grid computing resource and/or any other distributed computing arrangement. In some cases, the base station 108 may correspond to an elastic computing resource where the allotted capacity of processing, network, storage, or other computing-related resources may vary over time. The base station 108 may implement one or more virtual machines that use the resources of the base station 108.

Next is, a general description of the operation of the various components of FIG. 1 is provided. Upon installation in a light pole 101, the emergency support system 103 continuously monitors for motion. In non-emergency situations, motion is caused by vehicles moving past a light pole 101. Continuous monitoring involves monitoring for the presence of motion at a particular sampling rate that is sufficiently high to detect a vehicle driving by.

An emergency situation includes a stranded individual who is around the roadside. Because the roadside is not typically used for on-foot travel, the occurrence of a wandering individual amounts to anomalous motion activity. For example, if a vehicle breaks down and the driver has no immediate means to call for help, the driver may be forced to abandon his vehicle and search for help on foot. An emergency support system 103 is configured to differentiate the motion of a moving car (which expresses a typical motion pattern) and the motion of an individual who is walking (which expresses an anomalous motion pattern). The determination of an anomalous motion event occurs locally at the emergency support system 103.

The base station 108 is configured to communicate with each emergency support system 103 over the network. This may involve sending control signals to emergency support system 103 to poll data, receiving periodic transmissions of sample data from each emergency support system 103, or receiving other data from each emergency support system 103 such as, for example an indication of an anomalous motion event.

The base station 108 is configured to perform global processing using the sample data collected from a subset of emergency support systems 103 to determine if multiple anomalous motion events take place over a particular period of time. This global processing involves a spatial-temporal analysis to evaluate whether sample data across multiple emergency support systems reflect the motion of an individual who is in need of emergency assistance. In such a case, the base station 108 generates an alert and transmits it to one or more recipients to dispatch emergency services.

Figure 2:
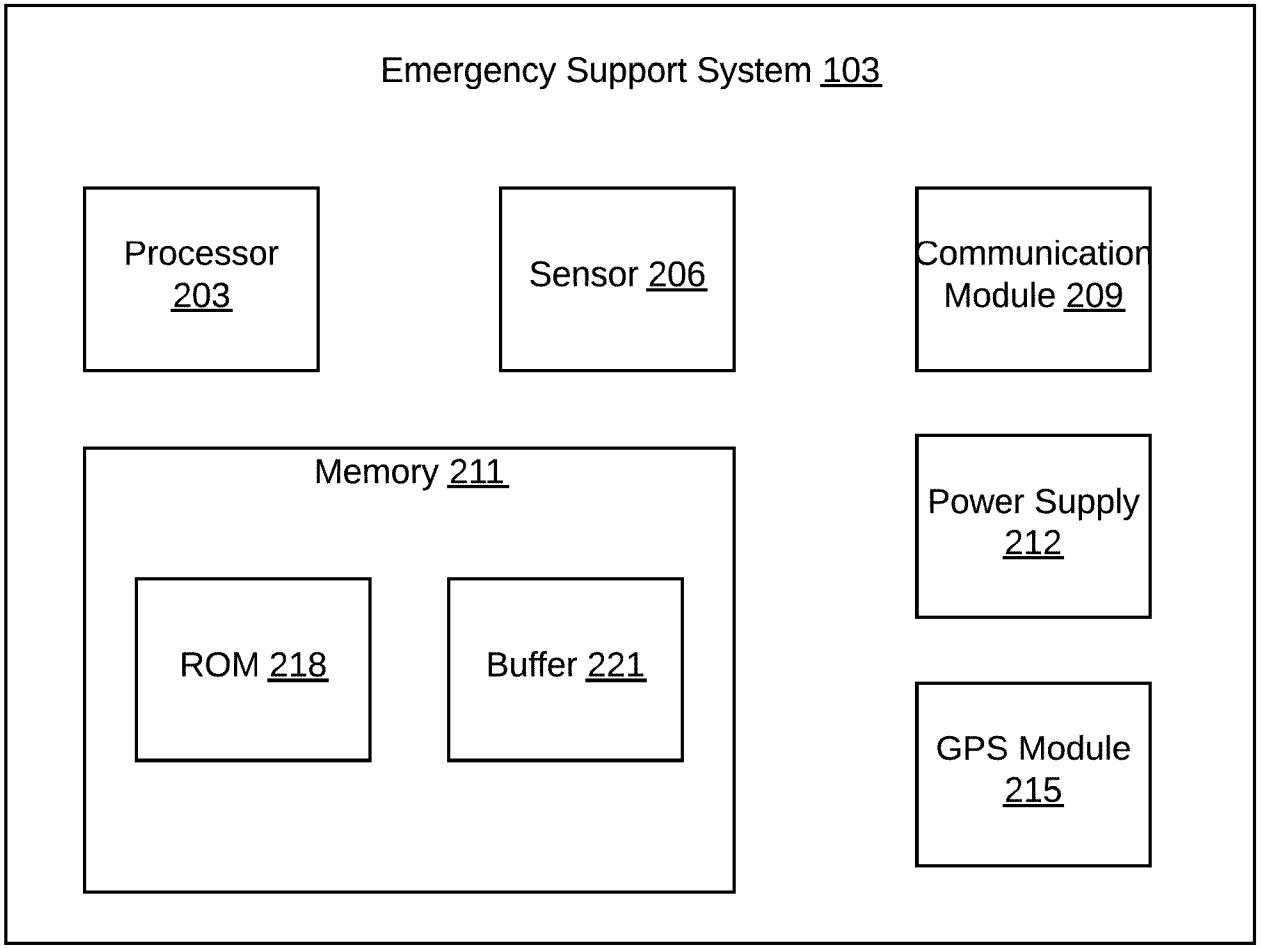

FIG. 2 schematically shows an embodiment of an emergency support system 103. The emergency support system 103 of FIG. 2 includes a processor 203, a sensor 206, a communication module 209, a memory 211, a power supply 212, and a GPS module 215. The processor 203 may be a microprocessor, Central Processing Unit (CPU) or a processor circuit which executes appropriate software stored therein. For example, the software may have been downloaded and/or stored in a corresponding memory 211. The processor may, in whole or in part, be implemented in programmable logic, e.g., as field-programmable gate array (FPGA) or may be implemented, in whole or in part, as a so-called application-specific integrated circuit (ASIC), i.e. an integrated circuit (IC) customized for their particular use. For example, the circuits may be implemented in CMOS, e.g., using a hardware description language such as Verilog, VHDL etc. The processor circuit may be implemented in a distributed fashion, e.g., as multiple sub-processor circuits or cores.

Memory 211 refers to a memory system that includes read-only memory (ROM) 218, random access memory (RAM), and a buffer 221. The memory 211 may comprise non-transitory computer readable medium for storing or loading computer instructions and for storing data on a temporary or permanent basis.

The ROM 218 may include solid-state memory used for data storage, such as, for example, Flash memory. The storage implemented by the ROM may be distributed over multiple distributed sub-storages. The ROM 218 may store the computer instructions that are executed by the processor 203 to carry out the functionality performed by the emergency support system 103.

The memory 211 also includes RAM (not pictured). This may be, for example, static random access memory (SRAM) and dynamic random access memory (DRAM), or magnetic random access memory (MRAM). If the ROM contains computer code, the computer code may be loaded into RAM for purposes of executing the computer code by the processor.

The memory may also include a buffer 221. The buffer may be implemented as volatile and/or non-volatile memory. The buffer stores a stream of data collected by the sensor 206. According to an embodiment, the buffer 221 is a circular buffer that overwrites older data with more recent data.

The sensor 206 is a sensor that detects the presence of motion. According to an embodiment, the sensor 206 is a passive infrared sensor. The sensor 206 detects motion by continuously sampling at a sample rate and recording the sample data into the buffer 221. As a result, the buffer 221 is filled with the most recent motion data collected by the sensor 206 on real time basis.

The communication module 209 includes circuitry to communicate with other devices connected to the network 105. For wireless networks 105, the communication module may include a radio frequency transmitter and/or receiver that sends or receives data packets over the network 105. The processor 203 is configured to control the communication module to cause the transmission of data stored in the emergency support system 103 or to transmit requests or other control signals to components connected via the network 105. The communication module 209 also transfers data it receives over the network 105 to the processor 203.

The emergency support system 103 also includes a power supply 212 according to an embodiment. The power supply 212 may be an adaptor, convertor, or any other circuitry that that couples to a power source that powers the light pole for purposes of powering the emergency support system 103. The power source of the light pole may be provided via an electrical grid using power cables. The power source may additionally or alternatively be provided by one or more solar panels. Because solar energy may be limited, the emergency support system 103 may be configured to restrict the transmission of data to longer intervals of periodic transmission or restricted to transmission only in the case of a detected event.

According to an embodiment, the emergency support system 103 further includes a GPS module 215 that obtains time and location data. The emergency support system 103 may transmit the time and location data to the base station 108 for example, using a push or poll operation. The base station 108 can track the location of the emergency support system in the event it is removed or re-installed elsewhere. In addition, the base station 108 may use the location information of the emergency support system 103 to calculate a subset of neighboring emergency support systems 103. The time data may be used for timestamping transmissions sent from an emergency support system 103 to the base station. For example, if the emergency support system 103 detects an anomalous motion event, it sends data indicating this event to the base stations 108 using the time data to express an accurate moment in time for the occurrence of the event.

As an alternative embodiment, the base station 108 may store a pre-programmed location for each emergency support system 103. The location for each emergency support system 103 may be recorded upon installation and then transmitted to the base station 108.

Figure 3:
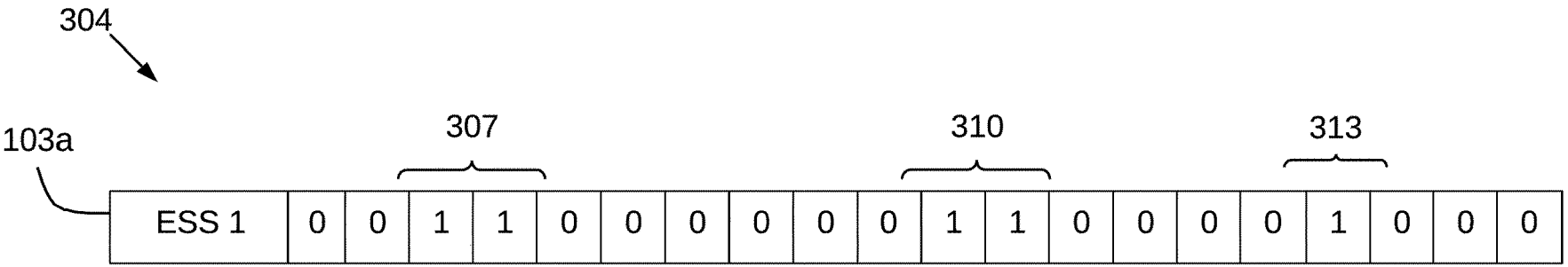

FIG. 3 schematically shows a detail of an example of an embodiment of sample data 304 generated at an emergency support system of FIG. 1. The embodiment depicted in FIG. 3 shows how the sample data 304 comprises a binary indication of whether motion was detected at each sample point. For example, a binary "1" indicates detected motion for a corresponding time while a binary "0" indicates that no motion was detected for a corresponding time. The data at each sample point is presented in a singular box. Thus, the sample data 304 is made up of a string of bits representing whether or not motion was detected.

Further, FIG. 3 shows sample data 304 collected by a first emergency support system 103*a*. The sample data 304 includes a series of binary values expressing whether or not motion is detected. At a first point in time, a first motion event 307 is detected. Later, a second motion event 310 is detected. And, even later, a third motion event 313 is detected.

A motion event includes a series of samples indicating the presence of motion. In the sample data 307 of FIG. 3, the series of samples indicating the presence of motion is expressed as consecutive 1's. The sample data 307 is recorded in the buffer 221, which is accessed by the processor 203. The processor reads the sample data 307 to determine a degree of motion activity by calculating the number of consecutive samples that indicate a presence of motion or by applying a time series calculation or machine-learning algorithm.

The sample data 307 of FIG. 3 is an example that represents three cars passing by a light pole, each car corresponding to its own motion event 307, 310, 313. Thus, the sample data 307 represents normal motion activity that does not warrant emergency response. FIG. 3 schematically shows a detail of an example of an embodiment of sample data 304 generated at an emergency support system of FIG. 1.

Figure 4:
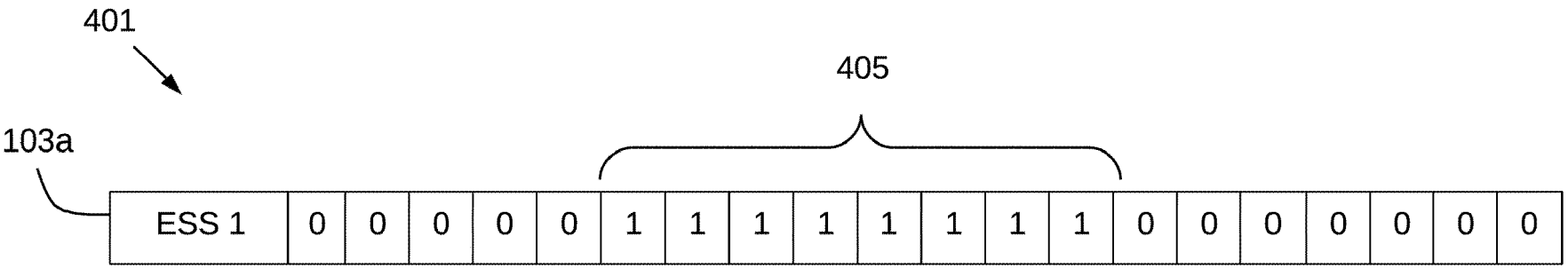

FIG. 4 schematically shows an example of sample data 401 generated at an emergency support system of FIG. 1. The example depicted in FIG. 4 shows how the sample data 401 comprises a binary indication of whether motion was detected at each sample point. This sample data may be taken by a first emergency support system 103*a*. The sample data 401 represents a relatively lengthy period of motion as a fourth motion event 405. When compared to the motion events 307, 310, 313 of FIG. 3, the fourth motion event 405 is considered an anomalous activity. This sample data 401 could represent an individual walking past a light pole, which would be realized as a much slower motion event compared to a vehicle driving past the light pole. An individual who is walking along the side of a road could warrant an emergency situation.

The sample data 401 might also represent motion that does not warrant an emergency situation such as a wandering animal or a car that is driving unusually slowly. Low cost sensor at one light pole might not be able to discern the difference between an emergency and a non-emergency situation. The base station 108 performs global processing, as discussed in more detail below, to reduce the likelihood of a false positive.

A processor 203 of the first emergency support system 103*a* may determine that the fourth motion event represents an anomalous motion event by comparing the degree of motion activity to a threshold. The threshold may be based on the motion of a moving vehicle. In the sample data 304 of FIG. 3, the motion events 307, 310, 313 show the motion of a moving car having motion that lasts no longer than the time of two samples. For example, if the sample rate is 1 sample per second, then the motion activity for each of the first three motion events 307, 310, 313 lasts less no more than 2 seconds. If the motion event for a car is typically 2 seconds, then a threshold amount of about 2 seconds may be used. Accordingly, a motion event lasting more than 2 seconds would be considered anomalous.

The fourth motion event 405, which has 8 consecutive samples indicating motion, demonstrates a motion event lasting over 7 seconds long (assuming a sample rate of 1 sample per second). Using a threshold of about 2 samples, the processor 203 would determine that the fourth motion event 405 is an anomalous motion event. In response, the processor causes data indicating the occurrence of the anomalous motion event to be transmitted to the base station 108. This data may include a flag and/or the sample data 401. It may also include additional sample data taken in real-time.

Figure 5:
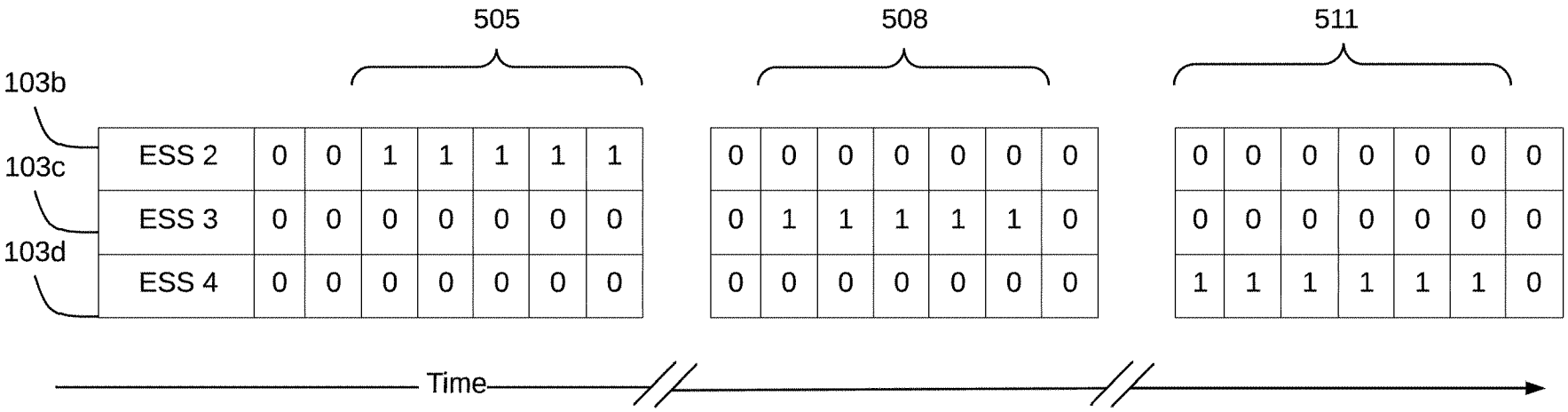

FIG. 5 builds on the example of FIG. 4. FIG. 5 schematically shows an example of an embodiment of sample data generated by multiple emergency support systems and received at a base station 108 of FIG. 1. Specifically, the example of FIG. 5 shows a base station receiving data indicating the occurrence of an anomalous motion event 405 from a first emergency support system 103*a*. In response, the base station 108 obtains sample data from a second emergency support system 103*b*, a third emergency support system 103*c*, and a fourth emergency support system 103*d*. The second, third, and fourth emergency support systems 103*b-d* are identified as a subset of emergency support systems based on the proximity relative to the first emergency support system 103*a*. In other words, the second, third, and fourth emergency support systems 103*b-d* were installed in the nearest light poles relative to the first emergency support system 103*a*.

The base station 108 obtains the sample data of the nearby emergency support systems such as the second, third and fourth emergency support systems 103*b-d*. The distance between each of these emergency support systems 130*b-d* may be equivalent to a 3 to 5 minute walk. The sample data of FIG. 5 depicts an individual walking past each of the second, third and fourth emergency support systems 103*b-d* at different points in time. The individual passes the second emergency support system 103*b*, which represents a first additional anomalous event 505. At that time, the third and fourth emergency support systems 103*c,d* do not detect any anomalous events. The individual then passes the third emergency support system 103*c*, which represents a second additional anomalous event 508. The individual also passes the fourth emergency support system 103*d*, which represents a third additional anomalous event 511.

In the example of FIG. 5, the base station 108 determines the occurrence of additional anomalous events 505, 508, 511 in a pattern that resembles an individual walking. Based on the spatial-temporal analysis, the base station 108 generates an alert.

The example in FIG. 5, shows a global analysis that is triggered from receiving an anomalous event from a first emergency support system 103*a*. The global analysis reduces the occurrence of a false positive detected by one emergency support system that performed a local analysis.

Figure 6:
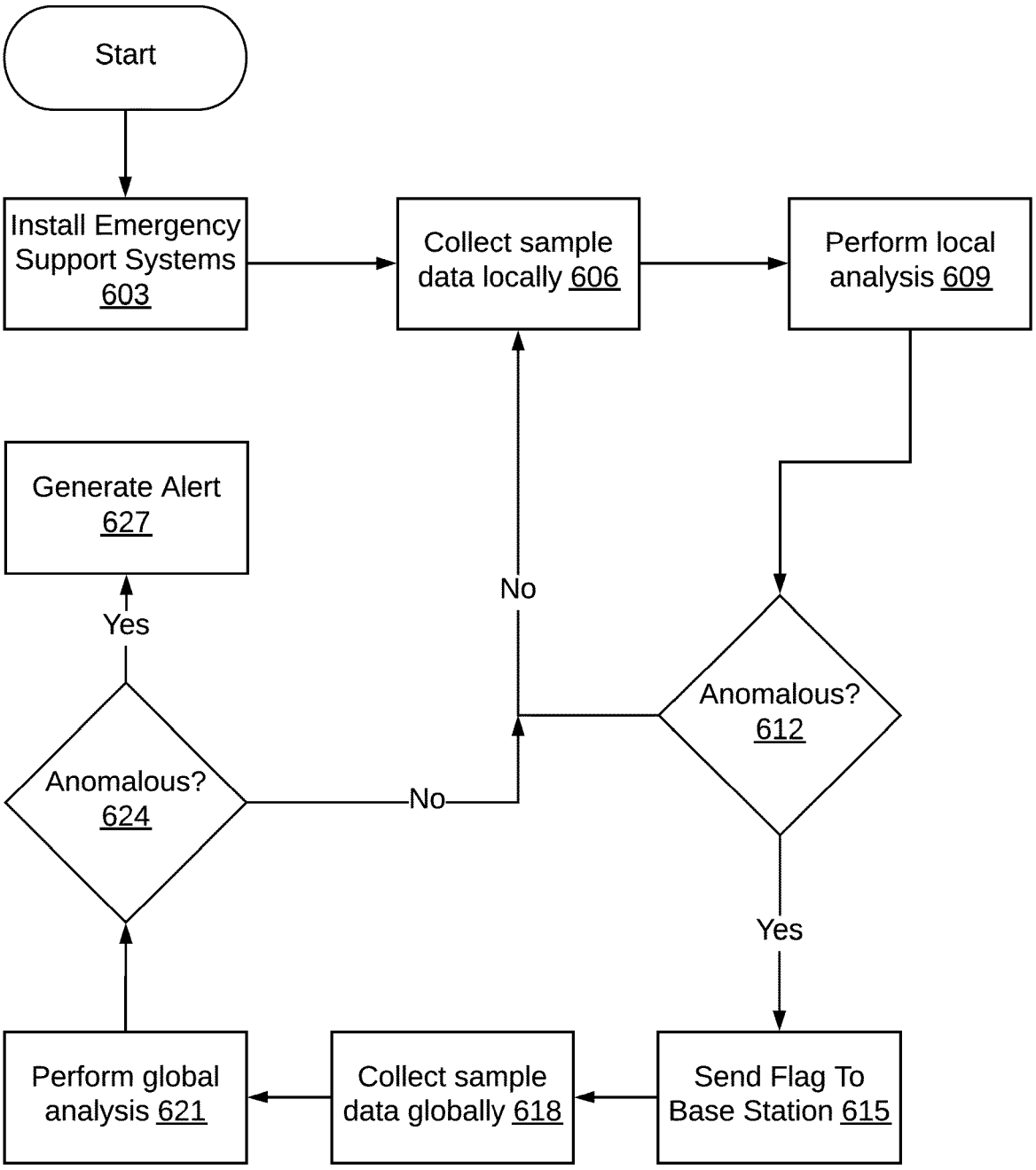
FIG. 6 is a flowchart illustrating an example of implementing an emergency support system in the field.

FIG. 6 is a flowchart illustrating an example of implementing an emergency support system in the field. FIG. 6 provides a high-level implementation of deploying multiple emergency support systems to perform the monitoring of motion on a local and global level. A 603, emergency support systems 103 are installed in corresponding light poles. At 606, a particular emergency support system 103 collects sample data locally. The emergency support system 103 continuously writes sensor data into their respective buffers 221 according to a predetermined sample rate.

At 609, a local analysis is performed at the emergency support system 103 to detect whether the sample data expresses an anomalous motion event. The processor 203 reads the sample data as it is being recorded to evaluate whether the data indicates a motion activity pattern that is anomalous. At 612, if the sample data indicates an anomalous motion activity, then at 615, emergency support system 103 transmits a flag to the base station 108. If it is not anomalous, the emergency support system 103 continues to analyze the sample data as it is being continuously recorded.

At 618, the base station 108 that receives a flag begins to collect sample data of nearby emergency support systems 103. At 621, the base station 108 performs a global analysis by analyzing whether the sample data of nearby emergency support systems 103 includes additional anomalous motion activity. At 624, if there is additional anomalous motion activity, an alert is generated at 627. The alert may be sent to a predefined recipient to cause the dispatching of emergency services. The recipient may include, for example, a police station, fire station, hospital, clinic or other emergency service provider. The recipient may also include a drone service. In this case, the drone service dispatches a drone that provides additional information about a detected motion event. A drone provides aerial imaging to allow other emergency service providers to assess whether an emergency exists. The alert may include the location and/or time of the most recent anomalous motion activity, the location and/or time of the initial anomalous motion activity, and an estimated speed of motion.

Figure 7:
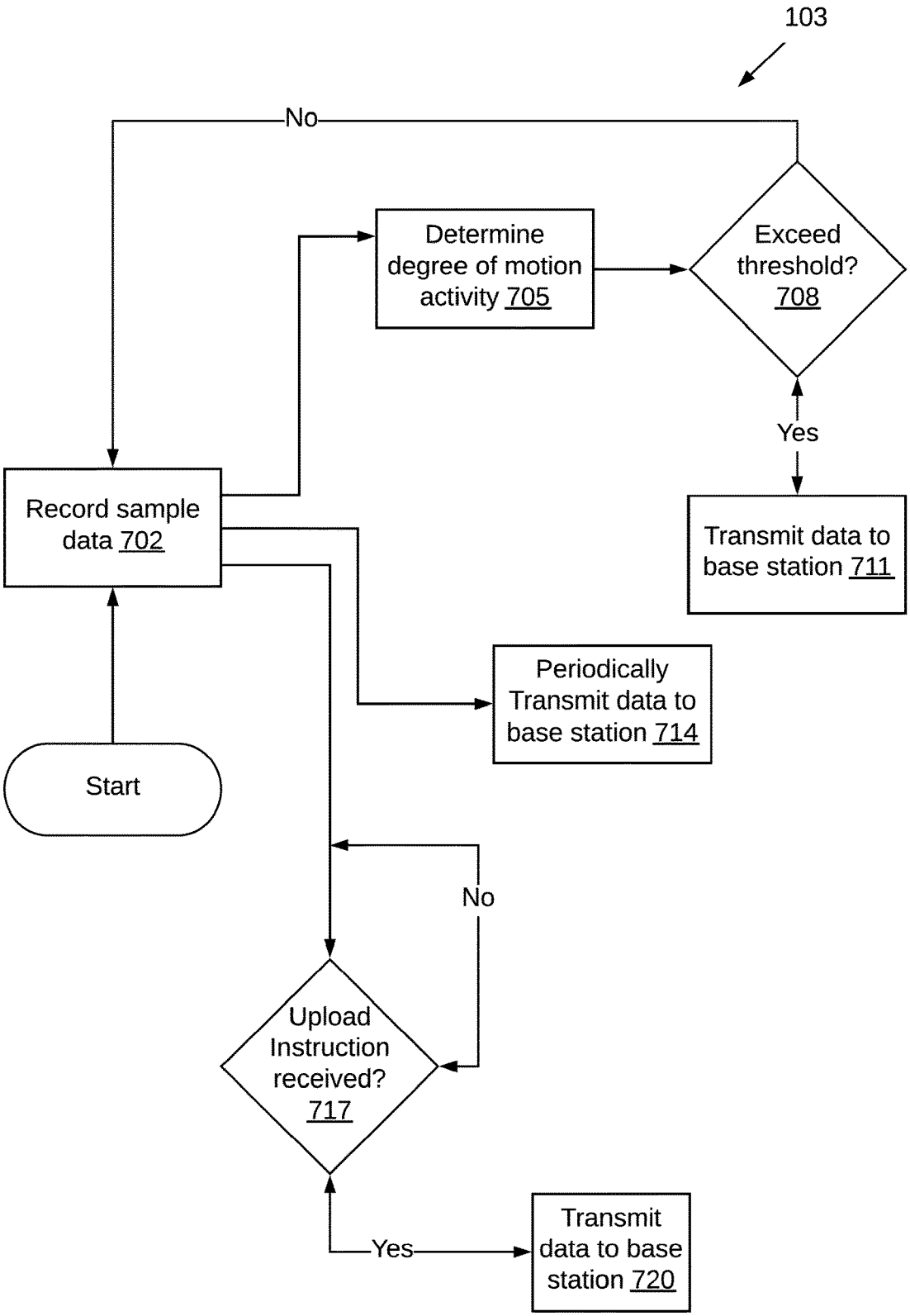
FIG. 7 is a flowchart illustrating an example of the functionality performed by an emergency support system of FIG. 1.

FIG. 7 is a flowchart illustrating an example of the functionality performed by an emergency support system 103 of FIG. 1. At 702, an emergency support system 103 records sample data. A sensor of the emergency support system 103 records sample data in a buffer. The sample data may be written as a bit stream in real time as the sensor continuously senses for motion. As the sample data is recorded, the processor of the emergency support system 103 analyzes the sample data to determine whether a threshold is exceeded, as depicted at 708. For example, the sample data reflects a degree of motion activity, which is determined by the emergency support system 103. The degree of motion activity may be quantified as the number of samples that indicate continuous motion or near continuous motion. A moving car has a relatively lower degree of motion activity because the duration of the motion is short, while a person walking has a relatively higher degree of motion activity because the motion lasts longer with respect to the sensor. Thus, the degree of motion activity is a quantification of the length of time that motion is detected.

The threshold may be a programed value set to differentiate the motion of a vehicle and motion of an individual who is walking. In other embodiments, the threshold may be determined based on historical data collected by a particular emergency support system 103. The historical data may reflect traffic conditions or traffic patterns over time. The historical data is obtained via a sensor 206 and stored in memory 221. The processor 203 analyzes historical data to determine an average duration of motion for varying periods of time. The threshold may be dynamically adapted over time such that it represents a statistically significant deviation from the average duration motion. The statistical significance may be quantified by a particular multiple of standard deviations. For example, if the average duration of motion from 8:00 AM to 9:00 AM lasts three samples, then the threshold may be dynamically adapted to be seven samples for this period of time, where seven is based at least in part on the standard deviation of the duration of motion.

At 708, the emergency support system 103 compares the degree of motion activity to the threshold to determine an occurrence of an anomalous motion event. If the threshold is exceeded, then at 711, the emergency support system 103 transmits to a base station 108 data indicating the occurrence of the anomalous motion event. The data may be a flag. The data may also include at least a portion of the contents of the buffer, which includes the sample data as it is continuously written into the buffer. As long as the threshold is not exceeded, the emergency support system 103 continues to record sample data.

In addition, at 714, the emergency support system 103 periodically transmits sample data to the base station 108. This periodic transmission may be performed in parallel to the threshold detection discussed at 711.

Furthermore, at 717, the emergency support system 103 waits for an upload instruction to be received from the base station 108. If an upload instruction is received, the emergency support system 103 transmits the sample data 720 that is continuously recorded into the buffer to the base station 108. This allows the base station 108 to collect sample data from a plurality of emergency support systems 103 to perform a global, spatial-temporal analysis for detecting an anomalous event on a global level.

Figure 8:
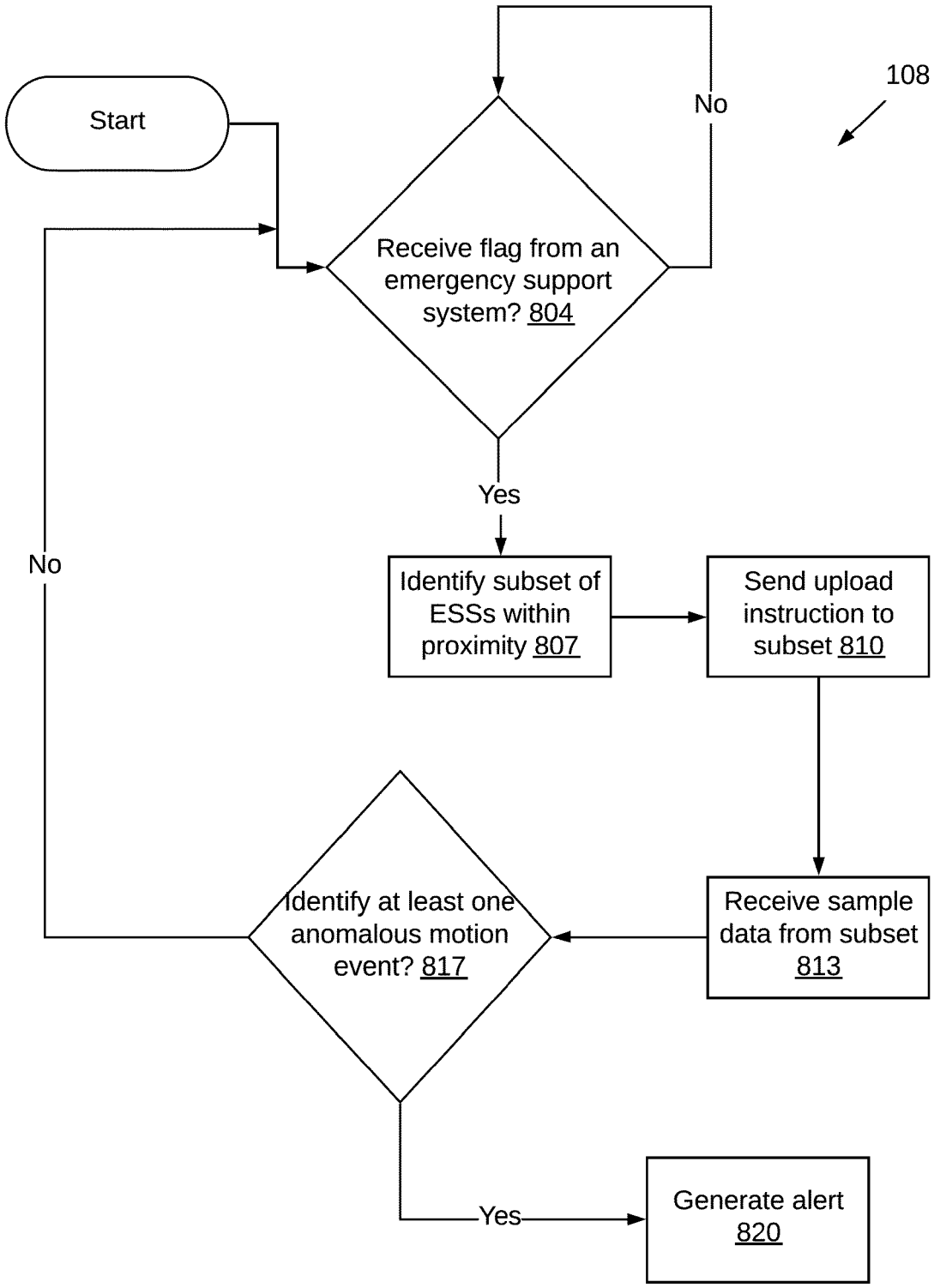
FIG. 8 is a flowchart illustrating an example of the functionality performed by base station of FIG. 1.

FIG. 8 is a flowchart illustrating an example of the functionality performed by base station 108 of FIG. 1. The base station 108 is configured to communicate with a plurality of other emergency support systems 103 installed in respective light poles. At 804, the base station 108 waits to receive a flag from an emergency support system 103. The flag may be an indication of the occurrence of the anomalous motion event detected locally at a particular emergency support system 103. In response to receiving a flag, the base station 108, at 807, identifies a subset of other emergency support systems based on the proximity relative to the particular emergency support system 103. The base station 108 selects the subset of emergency support systems 103 based on location data to identify the emergency support systems 103 closest to the particular emergency support system 103 that transmitted the flag. In this respect, each emergency support system 103 has a unique identifier and corresponding location to allow the base station to determine the subset.

At 810, the base station sends an upload instruction to the emergency support systems 103 in the subset. The upload instruction is a pull command or a request for a recipient emergency support system 103 to transmit its respective sample data. According to an embodiment, the upload instruction includes a start and stop time for when the respective sample data should be uploaded by an emergency support system in the subset. For example, if two emergency support systems 103 are spaced apart by a 15 minute walk, then the start and stop times of the data collection for the emergency support systems may be staggered by several minutes.

At 813, the base station 108 receives sample data from the subset of emergency support systems 103. The base station 108 may receive the sample data in real time as the emergency support systems 103 continuously monitor for motion. At 817, the base station 108 identifies at least one anomalous motion event. For example, the base station 108 performs a global analysis using the sample data collected from several, proximate emergency support systems 103 to detect a motion pattern that spatially and temporally spans multiples light poles. This global analysis reduces the likelihood of false positives. For example, the global analysis is able to discern an individual walking along a roadside across multiple light poles from a wild animal that passes a single light pole.

At 817, the base station 108 identifies whether additional anomalous motion events occur by analyzing the sample data in a manner similar to the local analysis described above with respect to 708 at FIG. 7. If no additional anomalous motion events are identified, the base station 108 continues to monitor for a flag, as depicted at 804.

When detecting for additional anomalous motion events, the base station 108 may evaluate the time difference between two anomalous motion events occurring at nearby emergency support systems 103. If the two anomalous motion events occur within a few seconds apart and the distance between them is a 10 minute walk, then this may not be deemed an emergency situation because it would impossible for an individual to walk that fast. Thus, when performing the global analysis, the base station 108 monitors for additional anomalous events and then determines whether those additional anomalous events amount to a pattern that warrants an emergency response. The base station 108 accounts for the time difference between the anomalous events and the distance between the location of the sources of the anomalous events.

At 820, the base station 108 generates an alert in response to the occurrence of an additional anomalous event. As discussed above, in addition to detecting whether the additional anomalous event occurs, the base station 108 may evaluate the one or more additional anomalous events and the initial anomalous event to determine whether it fits a spatial-temporal pattern that matches a stranded individual who is walking. For example, the base station 108 compares the time difference between the multiple anomalous events and the distance between the emergency support systems 103 associated with the anomalous events mirror the pattern of a stranded individual. In response to generating an alert, the base station transmits the alert to an emergency dispatch service such as, for example, the police or fire department.

Many different ways of executing the methods described above are possible, as will be apparent to a person skilled in the art. For example, the order of the steps can be varied or some steps may be executed in parallel. Moreover, in between steps other method steps may be inserted. The inserted steps may represent refinements of the method such as described herein, or may be unrelated to the method.

A method according to the invention may be executed using software, which comprises instructions for causing a processor system to perform the methods. Software may only include those steps taken by a particular sub-entity of the system. The software may be stored in a suitable storage medium, such as a hard disk, a floppy, a memory, an optical disc, etc. The software may be sent as a signal along a wire, or wireless, or using a data network, e.g., the Internet. The software may be made available for download and/or for remote usage on a server. A method according to the invention may be executed using a bit stream arranged to configure programmable logic, e.g., a field-programmable gate array (FPGA), to perform the method.

It will be appreciated that the invention also extends to computer programs, particularly computer programs on or in a carrier, adapted for putting the invention into practice. The program may be in the form of source code, object code, a code intermediate source, and object code such as partially compiled form, or in any other form suitable for use in the implementation of the method according to the invention. An embodiment relating to a computer program product comprises computer executable instructions corresponding to each of the processing steps of at least one of the methods set forth. These instructions may be subdivided into subroutines and/or be stored in one or more files that may be linked statically or dynamically. Another embodiment relating to a computer program product comprises computer executable instructions corresponding to each of the means of at least one of the systems and/or products set forth.

For example, a computer readable medium having a writable part comprising a computer program, the computer program comprising instructions for causing a processor system to perform a method of the present invention according to an embodiment. The computer program may be embodied on the computer readable medium as physical marks or by means of magnetization of the computer readable medium. However, any other suitable embodiment is conceivable as well. Furthermore, it will be appreciated that, although the computer readable medium may be an optical disc, the computer readable medium may be any suitable computer readable medium, such as a hard disk, solid state memory, flash memory, etc., and may be non-recordable or recordable. The computer program comprises instructions for causing a processor system to perform the method.

For example, in an embodiment, the processor may be arranged to execute software stored in the memory. For example, the processor may be an Intel Core i7 processor, ARM Cortex-R8, etc. The memory circuit may be an ROM circuit, or a non-volatile memory, e.g., a flash memory. The memory circuit may be a volatile memory, e.g., an SRAM memory. In the latter case, the verification device may comprise a non-volatile software interface, e.g., a hard drive, a network interface, etc., arranged for providing the software.

The foregoing detailed description has set forth a few of the many forms that the invention can take. The above examples are merely illustrative of several possible embodiments of various aspects of the present invention, wherein equivalent alterations and/or modifications will occur to others skilled in the art upon reading and understanding of the present invention and the annexed drawings. In particular, in regard to the various functions performed by the above described components (devices, systems, and the like), the terms (including a reference to a "means") used to describe such components are intended to correspond, unless otherwise indicated to any component, such as hardware or combinations thereof, which performs the specified function of the described component (i.e., that is functionally equivalent), even though not structurally equivalent to the disclosed structure which performs the function in the illustrated implementations of the disclosure.

The principles of the present invention are implemented as any combination of hardware, firmware and software. Moreover, the software is preferably implemented as an application program tangibly embodied on a program storage unit or computer readable storage medium consisting of parts, or of certain devices and/or a combination of devices. The application program may be uploaded to, and executed by, a machine comprising any suitable architecture. The computer platform may also include an operating system and microinstruction code. The various processes and functions described herein may be either part of the microinstruction code or part of the application program, or any combination thereof, which may be executed by a CPU, whether or not such computer or processor is explicitly shown. In addition, various other peripheral units may be connected to the computer platform such as an additional data storage unit and a printing unit.

Although a particular feature of the present invention may have been illustrated and/or described with respect to only one of several implementations, any such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising".

The present invention has been described with reference to the preferred embodiments. However, modifications and alterations will occur to others upon reading and understanding the preceding detailed description. It is intended that the present invention be construed as including all such modifications and alterations. It is only the claims, including all equivalents that are intended to define the scope of the present invention.

In the claims references in parentheses refer to reference signs in drawings of exemplifying embodiments or to formulas of embodiments, thus increasing the intelligibility of the claim. These references shall not be construed as limiting the claim.

The invention claimed is:

1. A method for providing emergency support by an emergency support system installed in a light pole, the method comprising:

recording, by a sensor of the emergency support system, sample data in a buffer, wherein the sample data indicates whether motion is detected at each sample time;

determining a degree of motion activity based on the sample data;

comparing the degree of motion activity to a threshold to determine an occurrence of an anomalous motion event; and transmitting to a base station data indicating the occurrence of the anomalous motion event, wherein the base station is capable of:

communicating with a plurality of other emergency support systems installed in respective light poles, each of the other emergency support systems being configured to record respective sample data;

identifying a subset of the at least one of the other emergency support systems based on the proximity relative to the emergency support system; and in response to the base station receiving the data indicating the occurrence of the anomalous motion event, transmitting an instruction to the subset to upload the respective sample data associated with the subset.

2. The method of claim 1, wherein the base station is further capable of:

receiving the respective sample data from the subset in response to the instruction;

determining whether the respective sample data from the subset expresses a second occurrence of an anomalous event; and generating an alert in response to determining the second occurrence of an anomalous event.

3. The method of claim 1, wherein the sample data comprises a binary indication of whether motion was detected at each sample time, wherein the degree of motion activity is determined by calculating the number of consecutive samples that indicate a presence of motion.

4. The method of claim 1, wherein the threshold is determined based on the motion of a moving vehicle.

5. The method of claim 1, wherein the emergency support system comprises a Global Position System (GPS) module, the method further comprising obtaining time and location data from the GPS module and transmitting the time and location data to the base station.

6. The method of claim 1, wherein the sensor comprises a passive infrared sensor.

7. The method of claim 1, further comprising periodically transmitting the sample data in a buffer to the base station at a predetermined interval.

8. The method of claim 1, wherein the emergency support system comprises a power supply that couples to a power source that powers the light pole.

9. The method of claim 1, wherein the buffer comprises a circular buffer that overwrites the sample data.

10. The method of claim 1, wherein the instruction to the subset comprises a start and stop time for when the respective sample data should be uploaded by each of the at least one of the other emergency support systems in the subset.

11. An emergency support system configured to be installed in a light pole, comprising:

a sensor configured to record sample data in a buffer, wherein the sample data indicates whether motion is detected at each sample time;

a base station;

a processor; and a memory that stores computer instructions, which, when executed, cause the processor to:

determine a degree of motion activity based on the sample data;

compare the degree of motion activity to a threshold to determine an occurrence of an anomalous motion event; and transmit to the base station data indicating the occurrence of the anomalous motion event;

wherein the base station is configured to:

communicate with a plurality of other emergency support systems installed in respective light poles, each of the other emergency support systems being configured to record respective sample data;

identify a subset of the at least one of the other emergency support systems based on the proximity relative to the emergency support system; and in response to the base station receiving the data indicating the occurrence of the anomalous motion event, transmit an instruction to the subset to upload the respective sample data associated with the subset.

12. The emergency support system of claim 11, wherein the base station is further configured to:

receive the respective sample data from the subset in response to the instruction;

determine whether the respective sample data from the subset expresses a second occurrence of an anomalous event; and generate an alert in response to determining the second occurrence of an anomalous event.

13. The emergency support system of claim 11, wherein the sample data comprises a binary indication of whether motion was detected at each sample time, wherein the degree of motion activity is determined by calculating the number of consecutive samples that indicate a presence of motion.

14. The emergency support system of claim 11, wherein the threshold is determined based on the motion of a moving vehicle.

15. The emergency support system of claim 11, further comprising a Global Position System (GPS) module, the method further comprising obtaining time and location data from the GPS module and transmitting the time and location data to the base station.

* * * * *